US008894552B2

(12) United States Patent
Wilson et al.

(10) Patent No.: US 8,894,552 B2
(45) Date of Patent: Nov. 25, 2014

(54) STRAP FOR ADAPTING A HEAVY BAG TO MODEL REAL-LIFE SITUATIONS FOR TRAINING

(76) Inventors: Matt Peter Wilson, Windham, NH (US); Bryan Paul Wilson, Windham, NH (US)

( * ) Notice: Subject to any disclaimer, the term of this patent is extended or adjusted under 35 U.S.C. 154(b) by 309 days.

(21) Appl. No.: 13/247,675

(22) Filed: Sep. 28, 2011

(65) Prior Publication Data

US 2012/0246884 A1 Oct. 4, 2012

Related U.S. Application Data

(60) Provisional application No. 61/469,956, filed on Mar. 31, 2011.

(51) Int. Cl.
*A63B 69/20* (2006.01)
*A63B 69/00* (2006.01)

(52) U.S. Cl.
CPC ..... *A63B 69/004* (2013.01); *A63B 69/20* (2013.01); *A63B 2209/10* (2013.01)
USPC ..... 482/83

(58) Field of Classification Search
CPC ..... A63B 69/004; A63B 21/1449; A63B 21/1415; A63B 21/1419
USPC ..... 2/69, 300–342; 482/69, 124, 139, 43, 482/129, 143, 78
See application file for complete search history.

(56) References Cited

U.S. PATENT DOCUMENTS 340,185 A * 4/1886 Adler ..... 2/312
396,938 A * 1/1889 Kemmler ..... 73/379.05
676,571 A * 6/1901 Waren ..... 2/311
D58,234 S * 6/1921 Holley ..... D21/406
1,906,693 A * 5/1933 Loughlin ..... 473/442
3,925,822 A * 12/1975 Sawyer ..... 2/421
4,434,980 A 3/1984 Babineaux
4,506,883 A * 3/1985 Rathbun ..... 482/13
4,557,477 A 12/1985 Clements et al.
4,685,668 A * 8/1987 Newlin, Jr. ..... 482/106
5,152,013 A * 10/1992 Johnson ..... 2/321
5,183,450 A 2/1993 Stelmach
5,281,191 A 1/1994 DeSousa
5,498,219 A * 3/1996 Soufi ..... 482/69
5,697,872 A * 12/1997 Stronsick et al. ..... 482/83
5,800,319 A * 9/1998 Choate ..... 482/83
5,806,087 A * 9/1998 Grotefend ..... 2/1
5,902,217 A 5/1999 Schechner et al.
5,961,406 A * 10/1999 Hass ..... 473/576
6,063,011 A 5/2000 Pelchat
6,302,831 B1 10/2001 Henry
6,432,027 B1 * 8/2002 Haselrig ..... 482/83
7,488,276 B2 2/2009 Luigi
2007/0015640 A1 * 1/2007 Demeniuk ..... 482/124
2007/0117689 A1 5/2007 MacKay et al.
2008/0026917 A1 1/2008 Campana
2008/0032872 A1 2/2008 Nappier
2010/0093503 A1 4/2010 Commeau
2012/0149536 A1 * 6/2012 Trimble et al. ..... 482/93

* cited by examiner

*Primary Examiner* — Stephen Crow
*Assistant Examiner* — Rae Fischer
(74) *Attorney, Agent, or Firm* — The John Marshall Law School Patent Clinic

(57) ABSTRACT

An attachment for a heavy bag to use while practicing power striking techniques in ground fighting. The attachment may be used on a bag that is hanging, resting on a free-standing base, or on a bag that has been removed from the hanger or base.

6 Claims, 2 Drawing Sheets

STRAP FOR ADAPTING A HEAVY BAG TO MODEL REAL-LIFE SITUATIONS FOR TRAINING

REFERENCE TO RELATED APPLICATIONS

This application claims priority to U.S. Provisional Application No. 61/469,956, filed Mar. 31, 2011, which is incorporated herein by reference in its entirety.

BACKGROUND OF THE INVENTION

The present invention generally relates to apparatus and methods for self-defense training and, more specifically, to apparatus and methods for self-defense training adapted to provide an effective way of training for real-life fighting situations.

Traditionally, training equipment for fighting, such as the various kinds of punching bags, allow a person to practice punching, kicking, and other such moves against a weighted object. A heavy bag, for example, can provide enough size and weight to practice various methods at maximum speed and power. A heavy bag is simply a large bag that is either a weighted bag that hangs, or a lighter bag on a weighted, free-standing base. Such bags can be used for punching or kicking, and may be held by a second person for more resistance during practice. These bags, however, do not allow for effective practice of ground-fighting techniques because they have no handles available. Such techniques require a person to grab and opponent, and they cannot be practiced on a heavy bag.

As can be seen, there is a need for an improved apparatus and method that enables a person to practice precision striking and ground-and-pound techniques with existing equipment, and that adequately simulates a real-life situation where such techniques would be necessary.

SUMMARY OF THE INVENTION

In one aspect of the present invention, a device comprises a first belt having a first end and a second end, a fitting at the first end, and a fastener at the second end; and at least one handle attached to the first belt; wherein the at least one handle runs parallel to the first belt.

In another aspect of the present invention, a device comprises at least two belts, each belt comprising: a first end; a second end; a buckle at the first end; and a plurality of hook-and-loop fasteners at the second end; at least two straps, each strap having a first strap end and a second strap end; wherein the first strap end of each strap is attached to the first belt; wherein the second strap end of each strap is attached to the second belt; and at least two handles attached to at least one of the at least two belts.

In another aspect of the present invention, a device comprises a plurality of belts; a plurality of straps attached to the belts; and a plurality of handles attached to the belts; wherein the belts and straps are attached perpendicularly to one another; wherein a plurality of the handles are parallel to the belts; and wherein a plurality of the handles are perpendicular to the belts.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, embodiments of the present invention generally provide a device that attaches to a heavy bag, allowing a person to practice punching, kicking, kneeing, and/or elbowing the bag with balance, power, speed, and precision in a manner that emulates real-life fighting situations.

Figure 1:
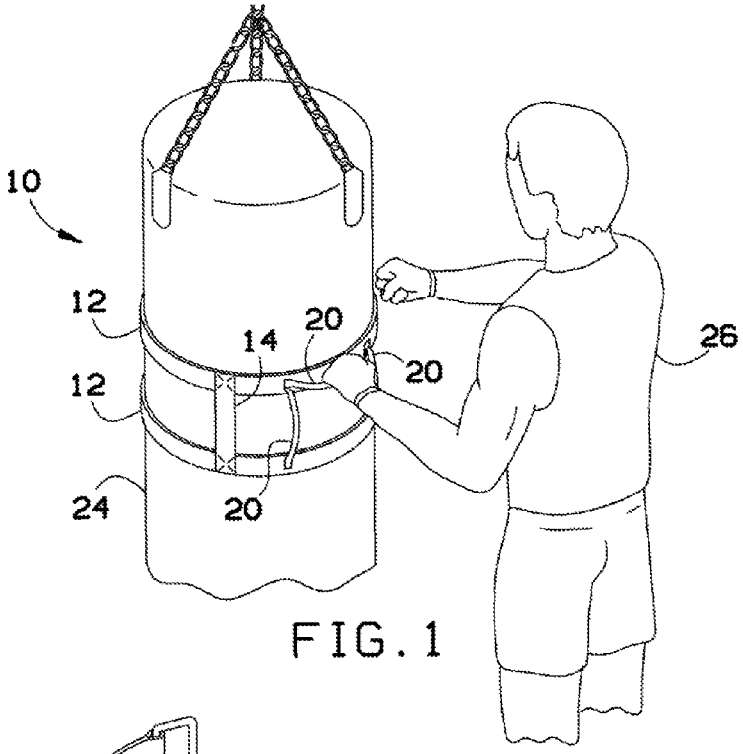
FIG. 1 is a perspective view of an embodiment of the present invention, shown in use.
Figure 2:
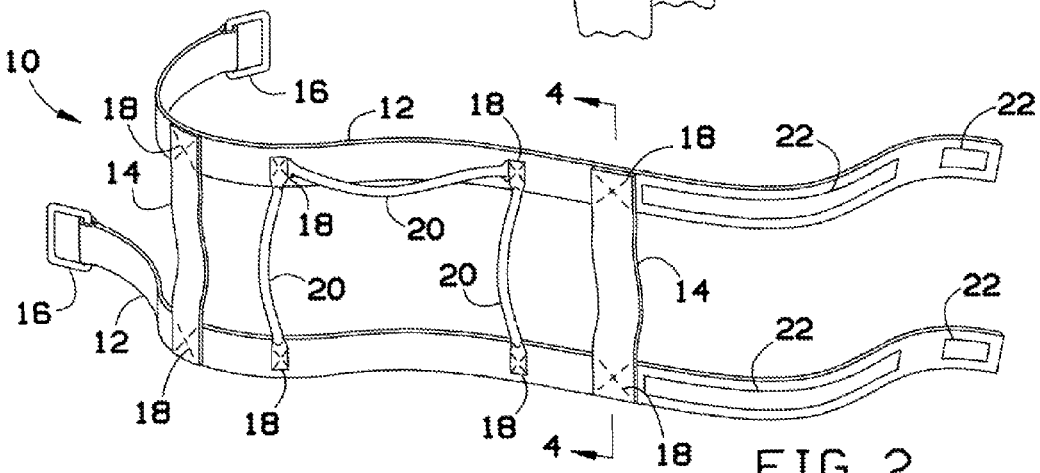
FIG. 2 is a perspective view of the embodiment of the present invention shown in FIG. 1.
Figure 4:
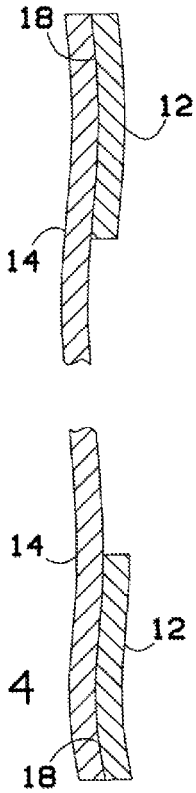
FIG. 4 is section view along the line 4-4 of the embodiment shown in FIG. 2.

FIG. 1 shows an embodiment of the device 10 attached to a bag 24, and in use by a person 26. Referring to FIG. 2, the device 10 may be constructed from two belts 12, measuring from about 3 to 5 feet long, typically about 4 feet long, and two straps 14, measuring from about 6 to 18 inches long, typically about 12 inches long. The belts 12 may be oriented parallel to one another, and the straps 14 may be attached to the belts 12 at attachment points 18 (FIG. 4), such that the straps 14 are perpendicular to the belts 12. The attachment points 18 may typically be secured with heavy nylon thread for strength. Each belt 12 may have a fitting 16 at one end, such as a buckle, and fastenings 22, such as hook-and-loop fastenings, on the other end. Other types of fittings 16 and fastenings 20 may be used without departing from the scope of the invention. Other straps or cord may be attached to the belt 12 to provide handles 20 that may be secured with attachment points 18. The various parts of the device 10 may be made from material that can handle over 200 pounds of pressure, including, but not limited to, heavy-duty cotton webbing, nylon, canvas, and other such materials.

Figure 3:
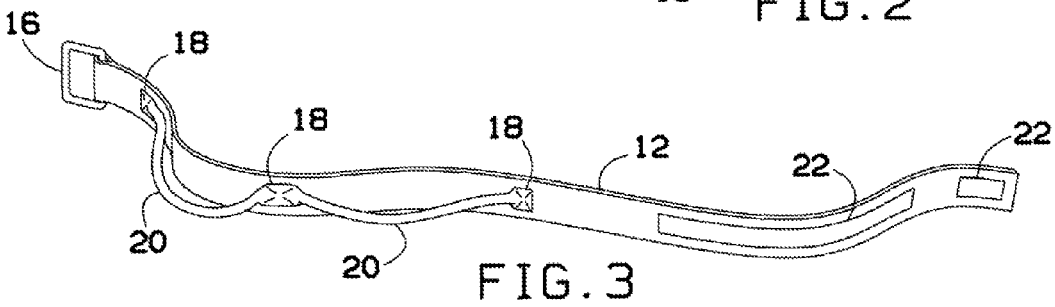
FIG. 3 is a perspective view of an alternate embodiment of the present invention.
Figure 5:
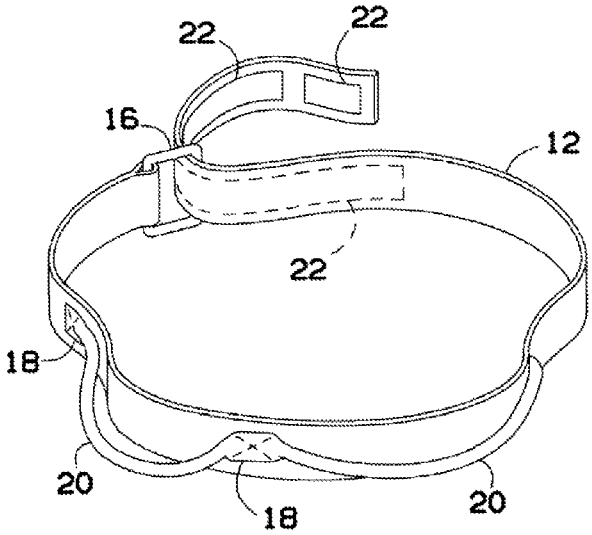
FIG. 5 is a perspective view of the embodiment of the present invention shown in FIG. 3, shown in the looped position.
Figure 6:
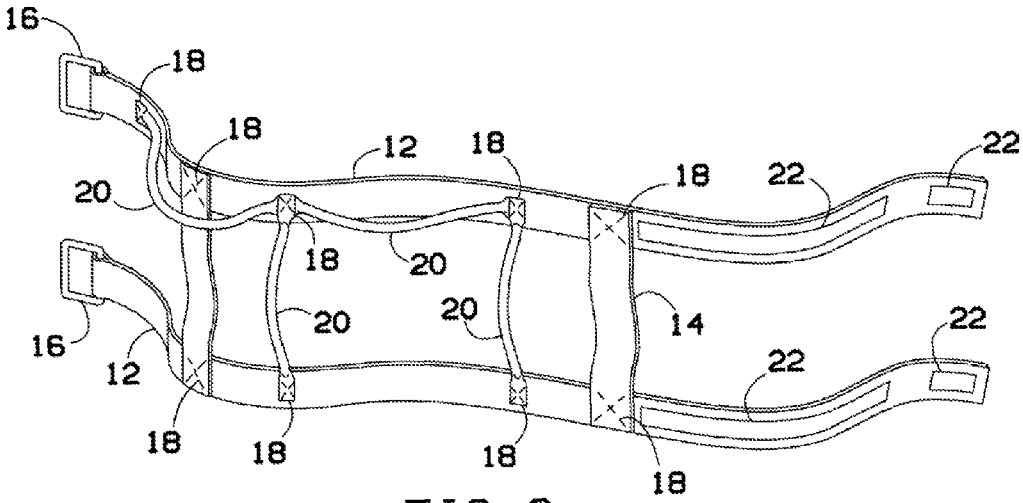
FIG. 6 is a perspective view of another alternate embodiment of the present invention.

An alternate embodiment is shown in FIGS. 3 and 5, in which only one belt 12 may be used. Similar to the belt 12 of FIG. 1, the belt 12 may have the fitting 16, handles 20 having attachment points 18, and the fastening 22. This embodiment may be used in substantially the same way as the first embodiment, but may also be used to practice additional, more specialized techniques. FIG. 6 shows another embodiment of the device 10, in which a different arrangement of handles 20 may be used.

In use, the device 10 may be fastened tightly about the bag 24. The fighter 26 may jab, punch, elbow, kick, and knee by grabbing the handles 20 and pulling or holding to improve power strikes as one would in a real life situation.

It should be understood, of course, that the foregoing relates to exemplary embodiments of the invention and that modifications may be made without departing from the spirit and scope of the invention as set forth in the following claims.

We claim:

1. A device comprising:

a suspended heavy bag for enabling a person to practice punching, kicking, kneeing, or elbowing the heavy bag;

at least two belts being disposed parallel to one another, said belts being adapted for encompassing an outer surface of the suspended heavy bag; each belt comprising:

a first end and a second end;

a fitting at the first end; and a plurality of hook-and-loop fasteners at the second end;

at least two straps, each strap having a first strap end and a second strap end;

wherein the first strap end of each strap is attached to the first belt;

wherein the second strap end of each strap is attached to the second belt;

at least two handles securely stitched to at least one of the at least two belts and;

wherein the at least two straps enable the person to exert a force to stabilize the heavy bag in response to the punching, kicking, kneeing, or elbowing by the person.

2. The device of claim 1, wherein each of the at least two handles is perpendicular to the at least two belts.

3. The device of claim 1, wherein each of the at least two handles enables the person to exert a force thereon to stabilize the heavy bag in response to the punching, kicking, kneeing, or elbowing by the person.

4. A device comprising:

a heavy bag for enabling a person to practice punching, kicking, kneeing, or elbowing the heavy bag;

at least two belts being disposed parallel to one another, said belts being adapted for encompassing an outer surface of the heavy bag; each belt comprising:

a first end and a second end;

a fitting at the first end; and a plurality of hook-and-loop fasteners at the second end;

at least two straps, each strap having a first strap end and a second strap end;

wherein the first strap end of each strap is attached to the first belt;

wherein the second strap end of each strap is attached to the second belt;

at least two handles securely stitched to at least one of the at least two belts and;

wherein the at least two straps enable the person to exert a force to stabilize the heavy bag in response to the punching, kicking, kneeing, or elbowing by the person.

5. The device of claim 4, wherein each of the at least two handles is perpendicular to the at least two belts.

6. The device of claim 4, wherein each of the at least two handles enables the person to exert a force thereon to stabilize the heavy bag in response to the punching, kicking, kneeing, or elbowing by the person.

* * * * *